US009765556B2

(12) United States Patent
Stots

(10) Patent No.: US 9,765,556 B2
(45) Date of Patent: Sep. 19, 2017

(54) HINGE LOCK

(71) Applicant: Jesse Stots, Boston, MA (US)

(72) Inventor: Jesse Stots, Boston, MA (US)

( * ) Notice: Subject to any disclaimer, the term of this patent is extended or adjusted under 35 U.S.C. 154(b) by 146 days.

(21) Appl. No.: 14/515,021

(22) Filed: Oct. 15, 2014

(65) Prior Publication Data

US 2015/0026925 A1 Jan. 29, 2015
US 2017/0211303 A9 Jul. 27, 2017

Related U.S. Application Data

(60) Division of application No. 13/318,127, filed as application No. PCT/US2010/033046 on Apr. 29, 2010, now abandoned, which is a continuation of application No. 12/433,833, filed on Apr. 30, 2009, now abandoned.

(51) Int. Cl.

*E05D 7/00* (2006.01)
*E05D 11/10* (2006.01)
*E05D 11/00* (2006.01)

(52) U.S. Cl.

CPC ..... *E05D 11/1007* (2013.01); *E05D 11/00* (2013.01); *E05Y 2201/22* (2013.01); *E05Y 2600/52* (2013.01); *E05Y 2900/20* (2013.01); *Y10T 16/533* (2015.01); *Y10T 16/5402* (2015.01); *Y10T 16/5403* (2015.01); *Y10T 16/54038* (2015.01); *Y10T 292/34* (2015.04)

(58) Field of Classification Search

CPC ..... E05D 11/06; E05D 11/10; E05D 11/1007; E05D 11/1028; E05D 2011/10; E05D 2011/1028; E05D 2011/1092; E05Y 2201/218; E05Y 2201/224; E05F 5/06; E05C 17/00; E05C 17/025

USPC ..... 16/82, 86 B, 250, 374, 375, 376; 292/288, 343, DIG. 15, 251.5, DIG. 17

See application file for complete search history.

(56) References Cited

U.S. PATENT DOCUMENTS

| | | | | |
|---|---|---|---|---|
| 146,776 | A * | 1/1874 | Nichols | 16/329 |
| 314,105 | A | 3/1885 | Carnes | |
| 485,613 | A | 11/1892 | Deane | |
| 853,507 | A * | 5/1907 | Fielding | 16/329 |
| 2,055,743 | A | 9/1936 | Falcone | |
| 2,201,594 | A | 5/1940 | Sitts | |
| 2,586,757 | A | 2/1952 | Wummel et al. | |
| 2,592,230 | A | 4/1952 | Allen | |
| 2,799,888 | A | 7/1957 | White | |

(Continued)

FOREIGN PATENT DOCUMENTS

| | | | |
|---|---|---|---|
| JP | 09203262 | A * | 8/1997 |
| WO | WO94/06990 | | 3/1994 |
| WO | WO95/23905 | | 9/1995 |

OTHER PUBLICATIONS

International Search Report for PCT/US2010/033046 dated Aug. 4, 2010.

*Primary Examiner* — Chuck Mah

(74) *Attorney, Agent, or Firm* — Jennifer Hayes; Nixon Peabody LLP

(57) ABSTRACT

A security lock that retrains movement of a hinge is described. A locking system that includes a hinge that includes a first connector, a second connector and a pivot pin, the first connector pivotable relative to the second connector around the pivot pin, and a lock configured to be positioned over the pivot pin to restrain movement of the first connector is described.

2 Claims, 12 Drawing Sheets

(56) References Cited

U.S. PATENT DOCUMENTS

| | | | | | |
|---|---|---|---|---|---|
| 2,839,779 | A | | 6/1958 | Haag | |
| 2,966,697 | A | | 1/1961 | Mintz | |
| 3,333,294 | A | * | 8/1967 | Warner | 16/375 |
| 3,602,942 | A | * | 9/1971 | Neff, Sr. et al. | 16/375 |
| 3,769,928 | A | * | 11/1973 | Kahl | 114/221 R |
| 3,918,121 | A | | 11/1975 | Williams | |
| 3,969,788 | A | * | 7/1976 | McCullough | 16/326 |
| 4,501,045 | A | * | 2/1985 | Boyer | 16/331 |
| 4,527,303 | A | | 7/1985 | Civitelli | |
| 5,143,468 | A | | 9/1992 | Pausch | |
| 5,265,922 | A | | 11/1993 | Falcone | |
| 5,490,306 | A | | 2/1996 | Floyd et al. | |
| 5,560,080 | A | | 10/1996 | Reed | |
| 5,642,910 | A | | 7/1997 | Betherum | |
| 5,881,431 | A | * | 3/1999 | Pieper, II et al. | 16/82 |
| 5,991,975 | A | | 11/1999 | Baer | |
| 6,311,367 | B1 | | 11/2001 | Larsen | |
| 7,891,056 | B2 | * | 2/2011 | McAfee | 16/374 |
| 7,904,992 | B2 | * | 3/2011 | Agster et al. | 16/82 |
| 2002/0129464 | A1 | | 9/2002 | Davis | |
| 2003/0226238 | A1 | | 12/2003 | Baer | |

* cited by examiner

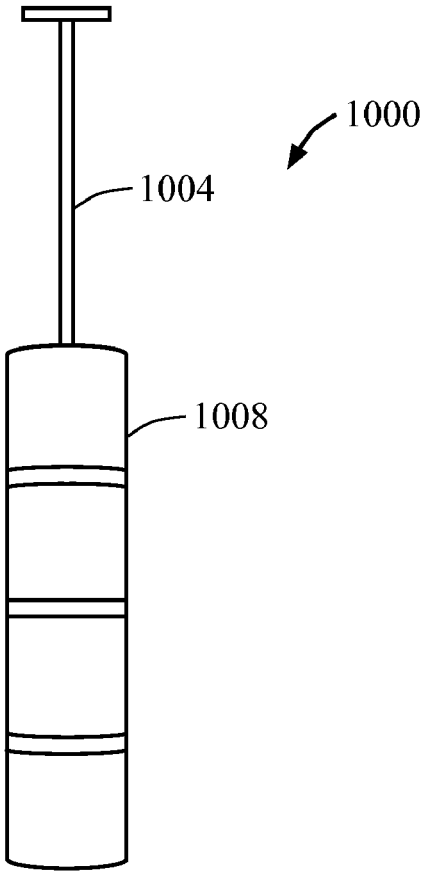
FIG. 10A
FIG. 10B
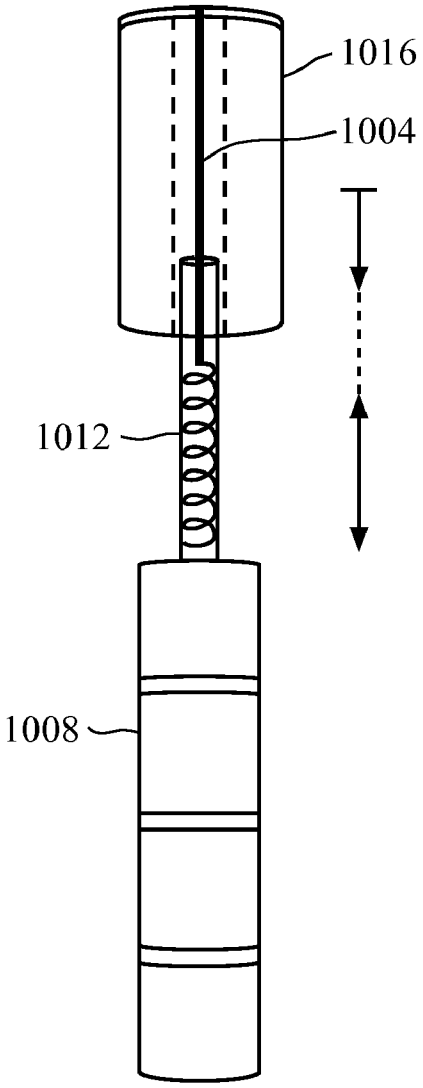

HINGE LOCK

This application is a divisional application of U.S. application Ser. No. 13/318,127, filed Apr. 16, 2012, titled "HINGE LOCK," which is a National Phase of International Application No. PCT/US2010/033046, which was filed on Apr. 29, 2010, and which is a continuation application and claims priority to and the benefit of U.S. application Ser. No. 12/433,833, filed on Apr. 30, 2009, and the disclosures of which are hereby incorporated herein by reference in their entireties.

BACKGROUND

1. Field

The subject invention relates to door locks and, in particular, to a hinge lock.

2. Related Art

Doors typically include both a spring (doorknob lock) and a deadbolt lock to prevent unwanted entry into a home. The deadbolt lock is a security lock that a resident of the home typically uses while they are in the home. Another typically door security lock is a security chain that allows the resident to open the door slightly while making it difficult for an intruder to force himself inside the home.

Parents of young children often use child safety locks to lock cabinets and drawers to prevent children from getting at any dangerous contents or accessing parts of the home that are dangerous for the child. The typical child safety lock includes a bendable plastic rod with a blunt hook on one side that is positioned inside the drawer or cabinet. The hook catches on a part of the drawer or cabinet door and prevents opening of the drawer or cabinet unless the rod is bent downward by the person opening the drawer or cabinet to disengage the hook. Another exemplary child safety lock is an electromagnetic cabinet locking device that is activated via remote control.

Each of the above locks, however, is difficult to install. Accordingly, what is needed is a security lock that can be used with doors and cabinets that is easy to install and provides the needed security.

SUMMARY

The following summary of the invention is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

According to an aspect of the invention, a lock is provided that includes a sleeved body having an inner surface, the inner surface shaped to correspond to a pivot pin of a hinge, and a groove in the sleeved body, the sleeved body securable around the pivot pin and the groove configured to restrain relative movement of the hinge.

The lock may further include a top, the top securable over a top surface of the pivot pin.

The lock may further include a bottom. The bottom may be releasably securable to the body.

The body may be configured to cover the entire length of the pivot pin. The body may be configured to cover a portion of the pivot pin.

The groove may extend the entire length of the body.

The body may include a cap and the groove may extend from the cap to the bottom of the body.

The lock may also include a locking hatch coupled to the body.

According to another aspect of the invention, a lock is provided that includes a body configured to be positioned around a pivot pin of a hinge to restrain movement of the hinge.

The body may be sleeved and may include a groove configured to apply pressure to connection elements of the hinge that are coupled to the pivot pin.

The body may be sleeved and may further include a longitudinal groove in the body.

The body further include a top. The body may further include a bottom.

According to a further aspect of the invention, a locking system is provided that includes a hinge comprising a first connector, a second connector and a pivot pin, the first connector moveable relative to the second connector around the pivot pin; and a lock configured to be positioned around the pivot pin to restrain movement of the first connector.

The lock may include a body having an opening and a groove in the body, the groove configured to apply pressure to the pivot pin.

The lock may include a hood and an opening.

The first connector may be coupled to a door. The second connector may be coupled to a wall. The second connector may be coupled to a cabinet frame.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIGS. 10A-10B illustrate a hinge lock for a hinge pin door hinge according to one embodiment of the invention.

DETAILED DESCRIPTION

A security lock that can be positioned on a hinge to restrain movement of the hinge is described. The security lock is a sleeve that is positioned around the cylindrical portion of the hinge and is made of a material that is sufficiently stiff to prevent relative movement of the hinge portions. The security lock can be used on its own or together with a conventional spring lock.

Figure 1:
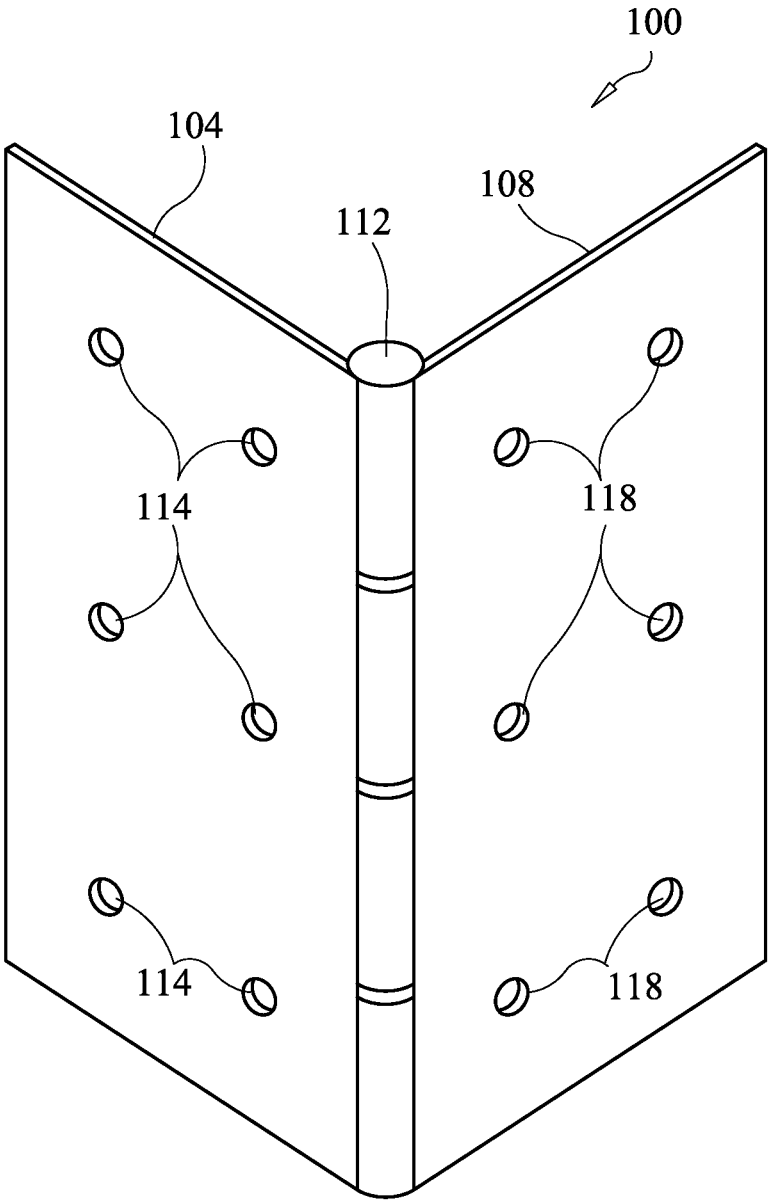
FIG. 1 is a schematic view of a door hinge according to one embodiment of the invention.

FIG. 1 illustrates a typical hinge 100. The hinge 100 includes two connector pieces 104, 108 (or wings) and a pivot 112 (or spine). One connector piece 104 is typically connected to a wall or other stationary object (e.g., a cabinet frame), while the other connector piece 108 is connected to the door or other movable object (e.g., cabinet). The connector piece 108 pivots relative to the connector piece 104 around the pivot 112 and typically has a limited angle of rotation (e.g., about 0-90° for most doors).

As shown in FIG. 1, each of the connector pieces 104, 108 includes openings 114, 118, respectively, to secure the connector pieces 104, 108 to their respective objects (e.g., door and wall, cabinet frame and cabinet, etc.).

Figure 2:
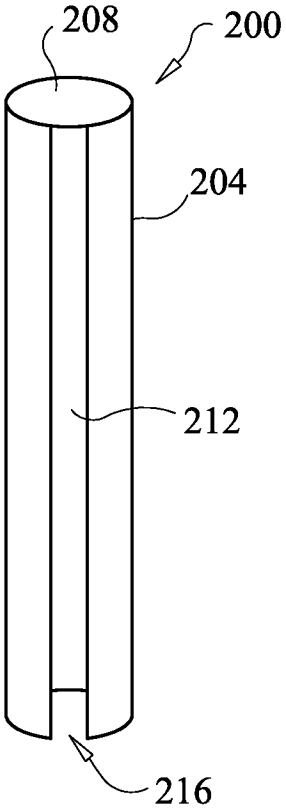
FIG. 2 is a perspective view of a hinge security lock according to one embodiment of the invention.
Figure 4A:
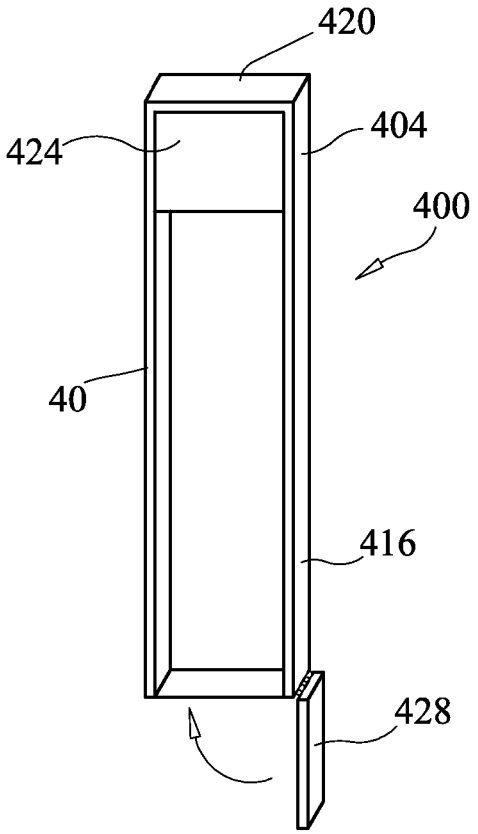
FIGS. 4A-4D illustrate a hinge security lock according to one embodiment of the invention.
Figure 4B:
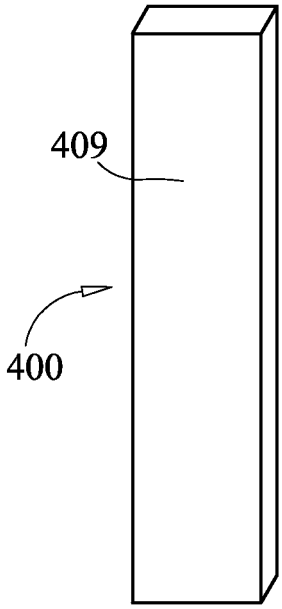
Figure 4C:
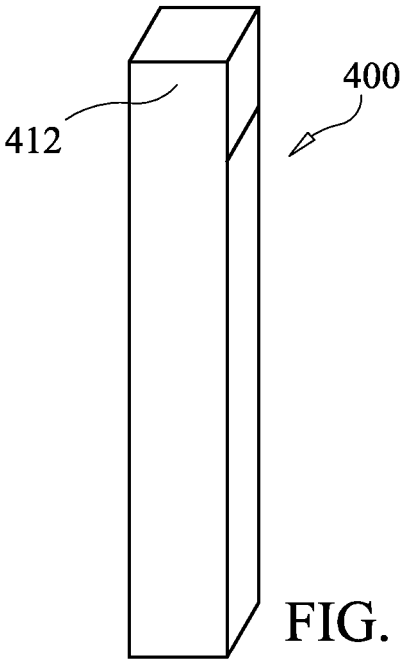
Figure 4D:
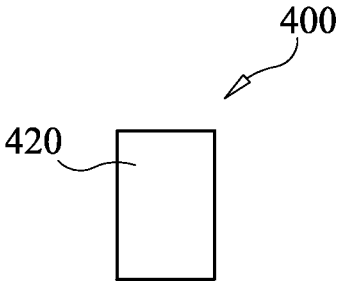

An embodiment of the invention will now be described in detail with reference to FIG. 2. A security lock 200 includes a sleeved body 204 that includes a top 208, side 212, and a longitudinal groove 216 in the body 208. The sleeved body 204 forms an opening 220.

The opening 220 is sized and shaped to fit around the pivot 112 of the hinge 100. The lock 200 can, therefore, restrain movement by limiting the angle of rotation of the hinge 100. In one embodiment, the groove 216 may be configured to apply pressure to the connectors 104, 108 to restrain the movement of connector 108.

The lock 200 is positioned on the hinge 100 by sliding the sleeved body 204 down over the pivot 112. The lock 200 can be removed by sliding the sleeved body 204 up away from the pivot 112.

Figure 3D:
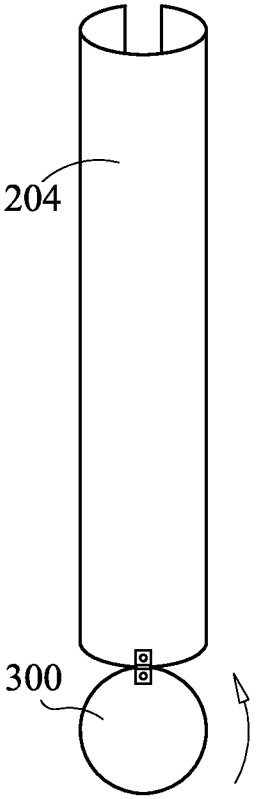
FIGS. 3A-3D are perspective views illustrating use of the hinge security lock according to one embodiment of the invention.
Figure 3C:
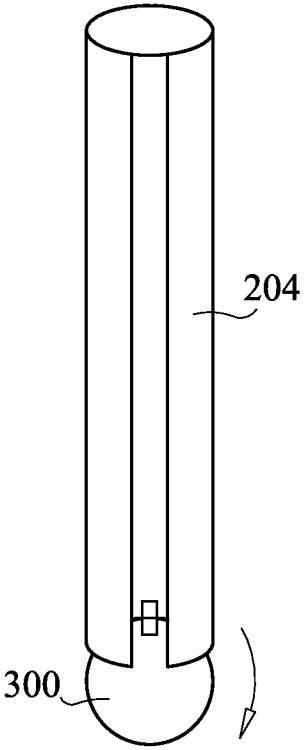
Figure 3B:
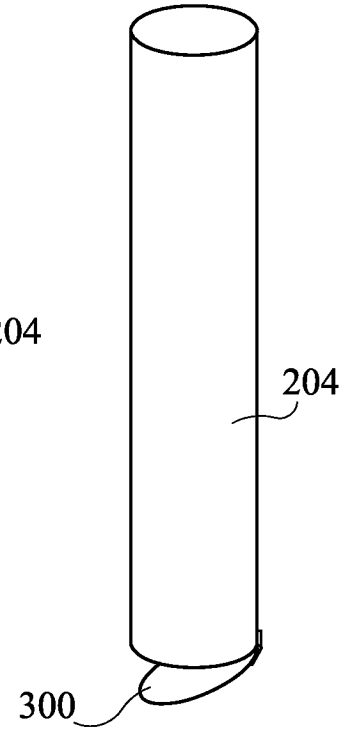
Figure 3A:
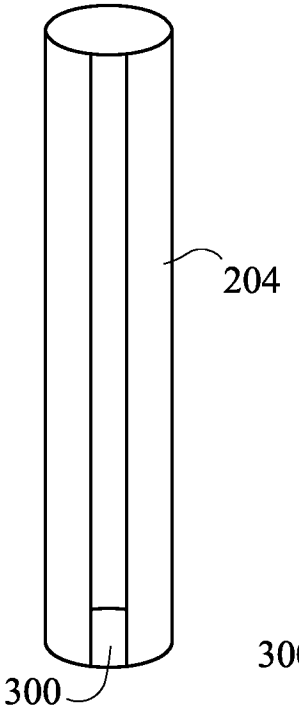

As shown in FIG. 3A-3D, the security lock 200 may optionally include a bottom 300. The bottom 300 is coupled to the sleeved body 204 and is configured to close to secure the opening 220 at the bottom of the sleeved body 204. As shown in FIGS. 3B and 3C, the bottom 300 is releasably coupled to the sleeved body 304. As shown in FIG. 3D, the sleeved body 204 may include a releasable bottom 300 and no top. Similarly, the sleeved body 204 may include a releasable top and no bottom. The bottom 300 can be used to further secure the sleeved body 204 to the pivot 112.

FIGS. 4A-4D illustrate a security lock 400 according to another embodiment of the invention. The security lock 400 has a rectangular cross-section; however, it will be appreciated that it may have a different cross-sectional shape.

The security lock 400 includes a sleeved body 404. The sleeved body 404 includes a back 408, a first side 412, a second side 416, a top 420, a cap 424 and, optionally, a releasable bottom 428. The sleeved body 404 includes an opening 428 that fits around the pivot pin and restrains movement of the connector elements of the hinge pin. Because the sleeved body 404 includes the cap 424, the lock 400 rests securely over the pivot 112. The bottom 428 can be secured to the body 404 to further secure the lock 400 to the pivot 112.

Figure 5A:
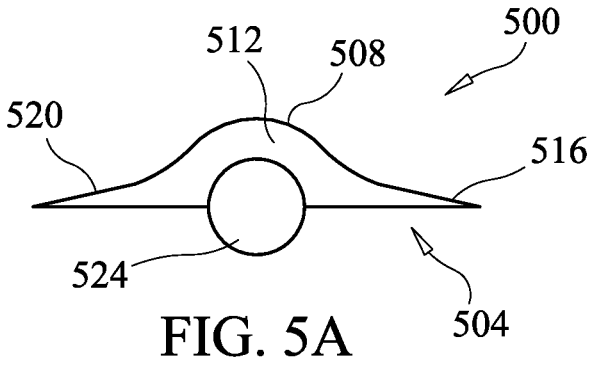
FIGS. 5A-5C illustrate a hinge security lock according to one embodiment of the invention.
Figure 5B:
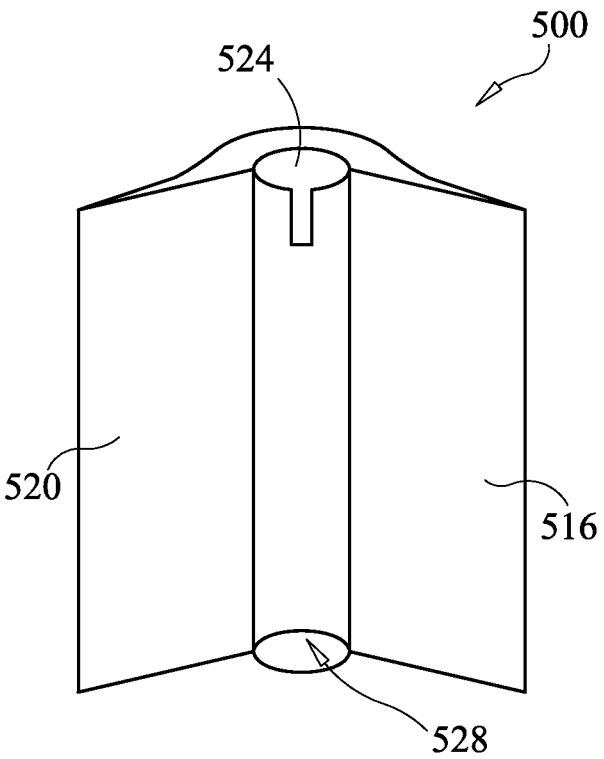
Figure 5C:
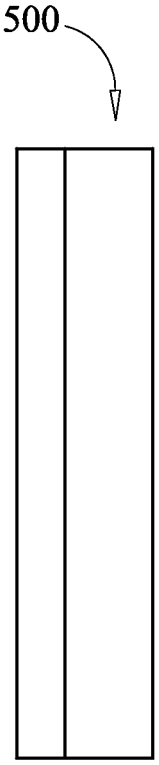

FIGS. 5A-5C illustrate a security lock according to another embodiment of the invention. The security lock 500 includes a hood 504 to further retrain the movement of the hinge.

The security lock 500 includes a body 508 that includes a main body portion 512, a first end body portion 516, a second end body portion 520 and a top 524. An opening 528 in the body 508 is configured to be positioned around the pivot 112 to prevent relative movement of the hinge 100. The end portions 516, 520 extend away from the pivot pin to form the hood 504, and extend over the wall frame or cabinet frame to prevent movement of the lock 500 when the connector end 108 is moved.

Figure 6A:
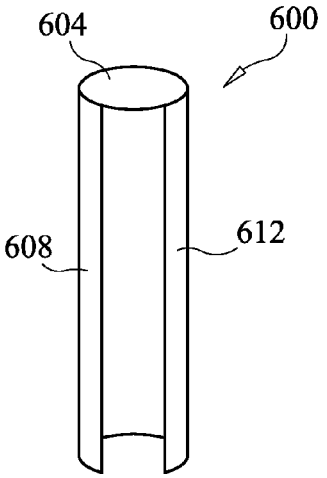
FIGS. 6A-6E illustrate a hinge security lock according to one embodiment of the invention.
Figure 6B:
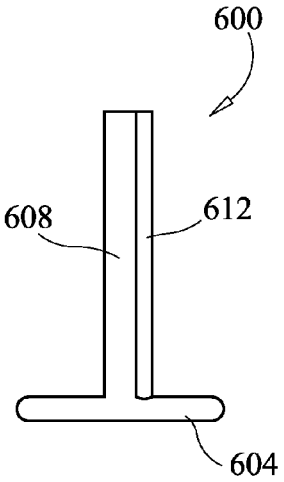
Figure 6C:
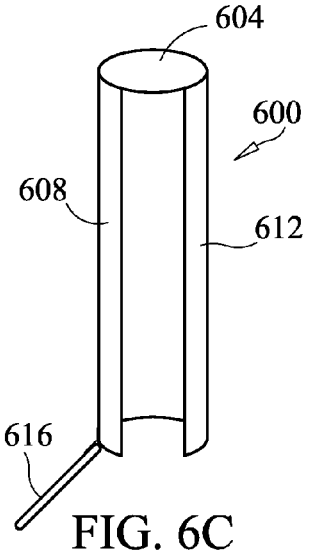
Figure 6D:
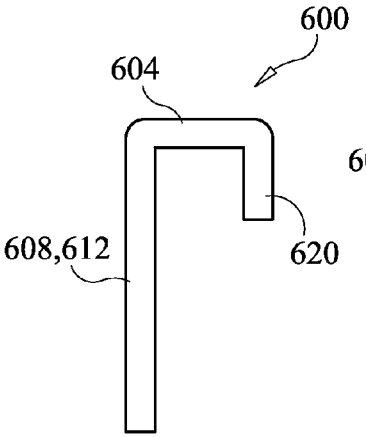
Figure 6E:
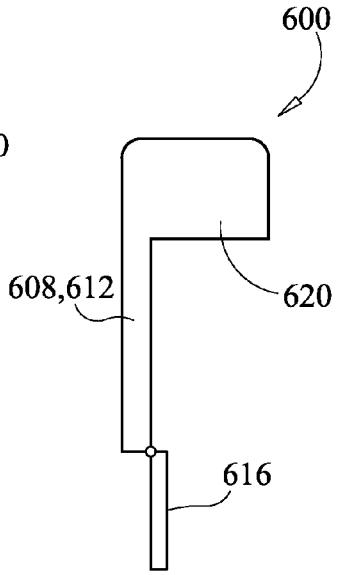

FIGS. 6A-6E illustrate a security lock according to another embodiment of the invention. The lock 600 is pronged and includes a top 604, a first prong 608 and a second prong 612. As shown in FIG. 6C, the lock 600 may, optionally, include a releasable bottom 616 to further secure the lock 600 around the pivot 112. As shown in FIGS. 6D and 6E, the lock 600 may be configured to hook over the top of the hinge pivot 112 to further secure the lock 600. For example, in FIGS. 6D and 6E, the top includes an extension 620 that extends downward.

Figure 7:
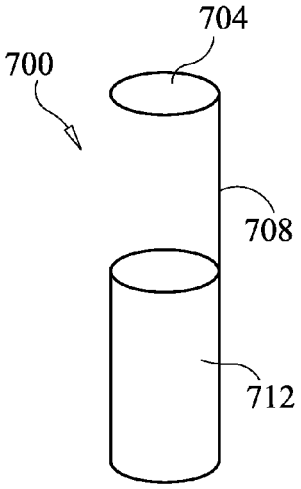
FIG. 7 illustrates a hinge security lock according to one embodiment of the invention.

As shown in FIG. 7, a security lock 700 according to another embodiment of the invention, includes a loop top or cap 704 to support and suspend the lock 700 over and on top of the hinge pivot 112. The cap 704 is coupled to a stem or prong-like neck 708 that is coupled to a base 712. The base 712 is positioned around the pivot 112 and prevents relative movement of the pivot 112. It will be appreciated that in other embodiment, the lock 700 may have a reversed configuration (i.e., the base 712 may be positioned at the top of the pivot 112 and the cap 704 positioned at the bottom of the pivot 112).

Figure 8A:
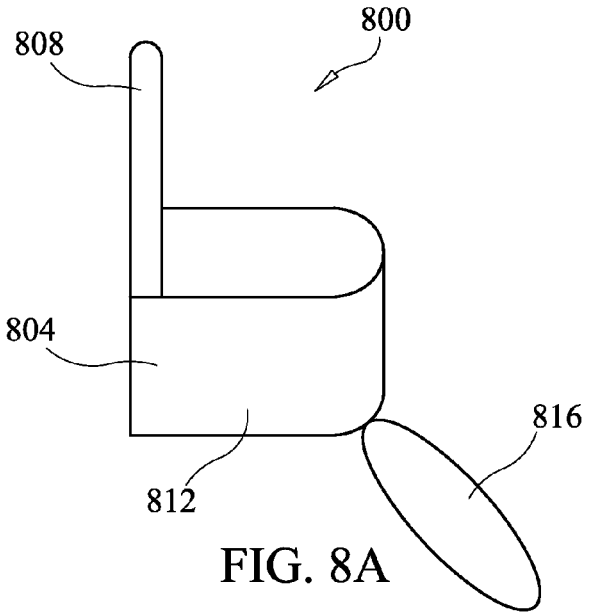
FIGS. 8A-8C illustrate a hinge security lock according to one embodiment of the invention.
Figure 8B:
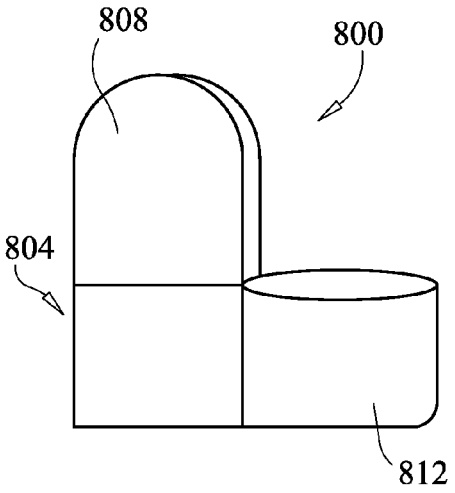
Figure 8C:
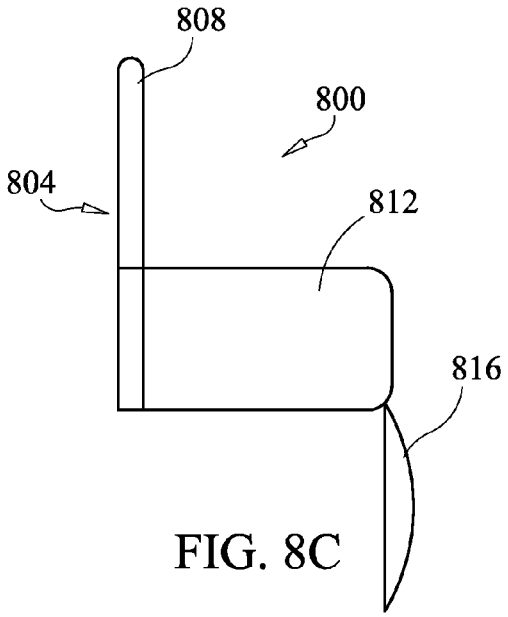
Figure 9A:
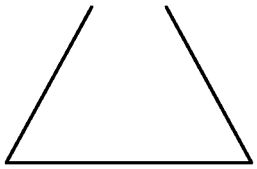
FIGS. 9A-9D illustrate shapes of the hinge security lock according to one embodiment of the invention.
Figure 9B:
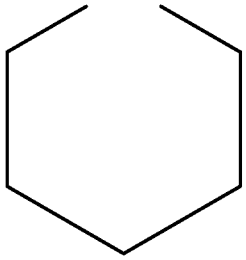
Figure 9C:
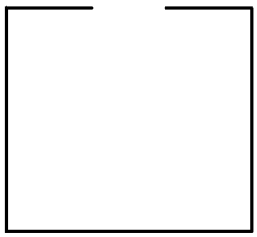
Figure 9D:
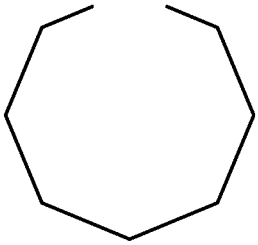
Figure 11A:
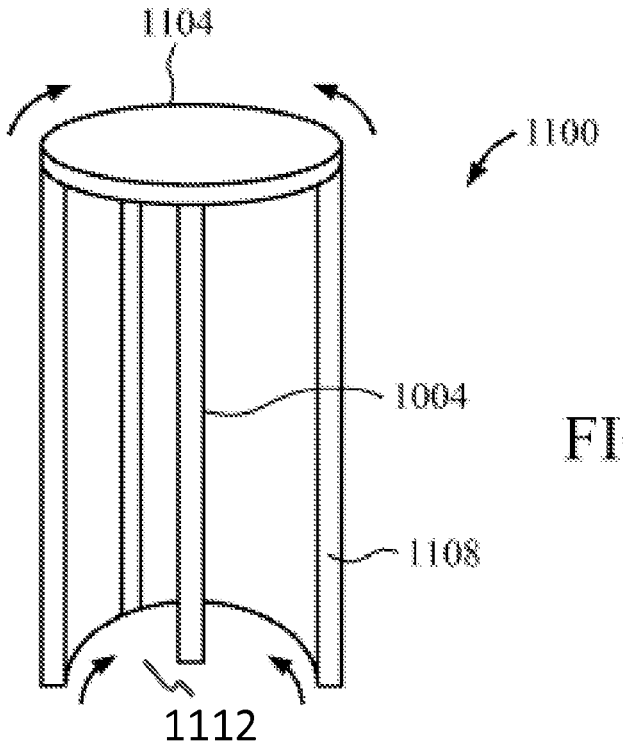
FIGS. 11A-11B illustrate a swivel hinge adjustable lock according to one embodiment of the invention.
Figure 11B:
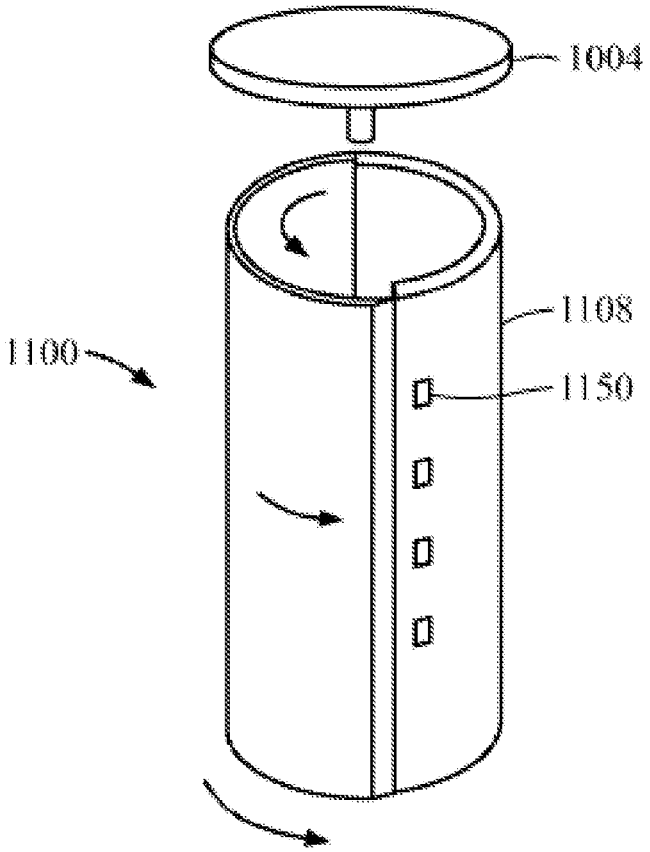

As shown in FIGS. 8A-8C, the lock may be a short security lock 800. The base or hoop 804 can be adjusted in length to fit a variety of hinges. The lock 800 includes a loop frame 808 with a curved base 812. The loop 804 rests on top and hooks over the hinge connector instead of resting only on the hinge pivot 112, and the body or base 812 curves around the hinge pivot 112. In one embodiment, the body 812 rests midway on the hinge 100, or, in another embodiment, the body 812 can be extended to the bottom of the hinge and locked using the releasable bottom 816.

As shown in FIGS. 9A-9D, the cross-sectional shape of the security lock can be any of a variety of shapes. Exemplary shapes include triangular, polygonal, square, octagonal and the like.

It will be appreciated that the locks described herein should be made from a stiff and sturdy material such as a metal or hard plastics. Exemplary materials include, but are not limited to, stainless steel, aluminum, DELRIN, and the like.

It will also be appreciated that the locks described herein may include two parts that are securable to one another. For example, the lock may include an upper half and a lower half, the upper half slideable down the pivot 112 and the lower half slideable up the pivot 112 and coupleable to one another using a number of attachment means. Similarly, the lock may include a left side and a right side that are coupleable to one another using an attachment means.

It will also be appreciated that the hinge locks described herein may be positioned on only one or a portion of the door or cabinet hinges or may be positioned on each of the door or cabinet hinges.

The locks shown in FIGS. 10A-13B use stationary mechanical hinge locks that are connected to door hinges.

The locks are affixed to the door hinge itself via a hinge pin that is spring loaded inside the door hinge. The hinge pin and lock are installed into the door or gate hinge.

When the lock body and pin compressed down, the mechanical lock stays down over the hinge in a locking position. The lock body covers the hinge to prevent the hinge from swinging open. When decompressed, the spring-loaded pin releases the lock body, allowing it to pop up, which allows the door or gate to swing open.

It will be appreciated that the lock shapes and mechanisms may vary as described previously. In addition, it will be appreciated that the shapes and mechanisms of the locks may vary depending on the hinge to be locked. It will be further appreciated that the locks disclosed herein may be used with any stationary or spring-loaded lock.

FIGS. 10A-10B illustrate a hinge lock for a hinge pin door hinge according to one embodiment of the invention. As shown in FIG. 10A, the hinge 1000 includes a hinge pin 1004 slideably insertable into a hinge body 1008. As shown in FIG. 10B, a spring loaded shaft 1012 is provided in the hinge body 1008, and the hinge pin 1004 is coupled to the spring-loaded shaft 1012. A hinge lock 1016 is coupled to the hinge pin 1004. As described above, the hinge pin 1004 is pressed into the shaft 1012 to secure the lock 1016 to prevent movement of the hinge body 1008 and, therefore, the door. Decompressing the spring releases the lock so the hinge can move again, therefore, allowing movement of the door.

It will be appreciated that in an alternative embodiment, the hinge lock 1016 does not need to be used with a spring loaded shaft 1012. In embodiments in which the spring loaded shaft 1012 is not used, the hinge lock 1016 may be lifted upward to allow movement of the hinge body 1008.

Figure 12A:
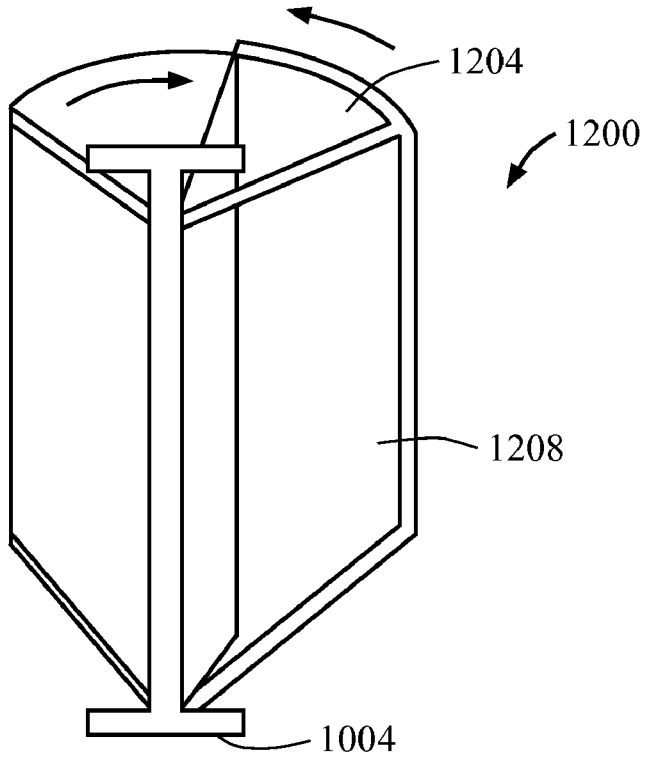
FIGS. 12A-12B illustrate a swivel hinge adjustable lock with an adjustable hood according to one embodiment of the invention.
Figure 12B:
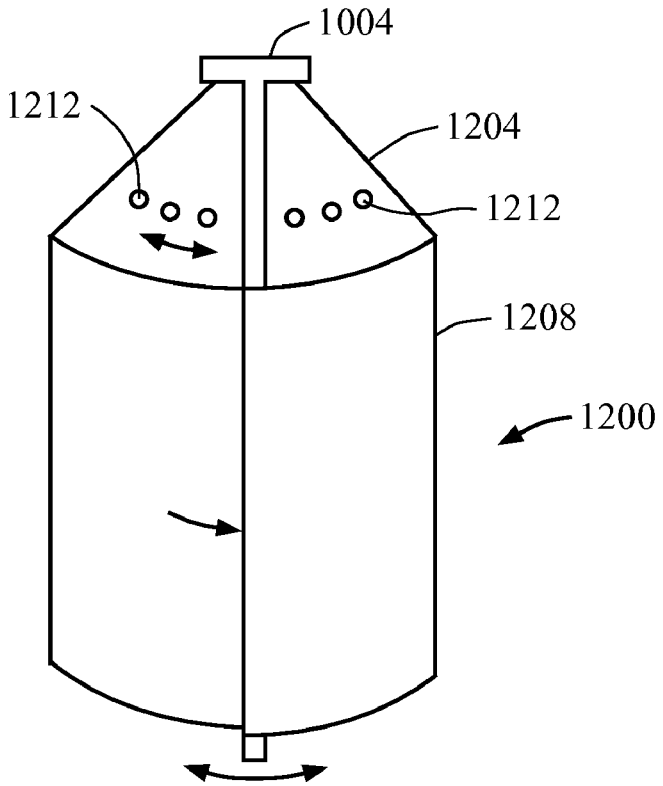

FIGS. 12A-12B illustrate an exemplary hinge lock (front and back view) that can be used as hinge lock 1016. The hinge lock shown in FIGS. 12A-12B is adjustable depending on the angle and space of the hinge enclosure. As shown in FIG. 12A, the hinge lock 1200 includes a sliding hood 1204 and/or walls 1208 to secure the hinge lock 1200 to the pin 1004. As shown in FIG. 12B, the adjustable hood and/or sleeve can slide left and right depending on the angle and space of the hinge to which it is being coupled. The hinge lock 1200 may include a locking mechanism 1212 as well. For example, in FIG. 12B, spring loaded teeth or prongs that are insertable into corresponding openings in the hinge lock body may be used to lock/unlock the hinge lock 1200 to the hinge pin 1004

FIGS. 12A-12B illustrate an exemplary hinge lock (front and back view) that can be used as hinge lock 1016. The hinge shown in FIGS. 12A-12B is adjustable depending on the angle and space of the hinge enclosure. As shown in FIG. 12A, the hinge 1200 includes a sliding hood 1204 and/or walls 1208 to secure the hinge 1200 to the pin 1004. As shown in FIG. 12B, the adjustable hood and/or sleeve can slide left and right depending on the angle and space of the hinge to which it is being coupled. The hinge 1200 may include a locking mechanism 1212 as well. For example, in FIG. 12B, spring loaded teeth or prongs that are insertable into corresponding openings in the hinge may be used to lock/unlock the hinge lock to the hinge pin 1004.

The locks of FIGS. 11A-B and 12A-B are both secured around the hinge body to prevent movement of the hinge. Decompressing the teeth (or other locking mechanism) releases the hinge lock from the hinge, allowing movement of the hinge (and door) again.

Figure 13A:
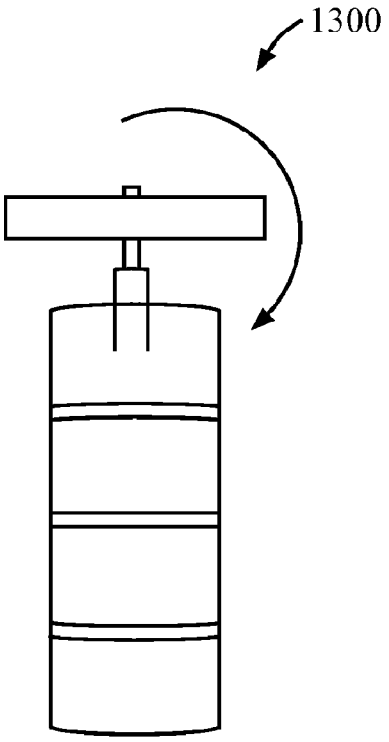
FIGS. 13A-13C illustrate a hinge lock having a swivel pin lock according to one embodiment of the invention.
Figure 13C:
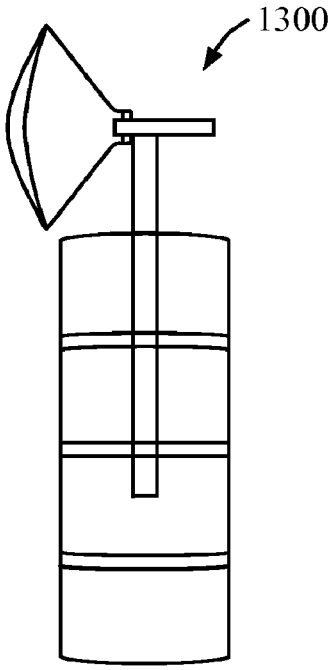
Figure 13B:
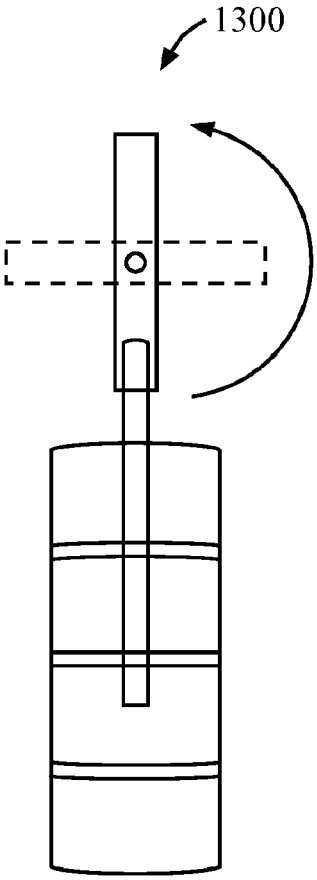

FIGS. 13A-13C illustrate a hinge lock 1300 having a swivel pin lock according to one embodiment of the invention. FIG. 13A illustrates a swivel anvil 1304 in a locking position. The anvil 1304 applies pressure to the door and door jam serving as an obstacle preventing the door from swinging open. FIG. 13B illustrates the anvil 1304 in a upright position, allowing the door or gate to swing open. FIG. 13C illustrates a side view of the swivel lock with the anvil 1304 in the open and up position installed on the hinge pin 1004. In other embodiments, the anvil 1304 may be a straight rod or bar. Twisting the rod or bar or sliding it in and out of place may be used to block movement of the door.

Figure 14:
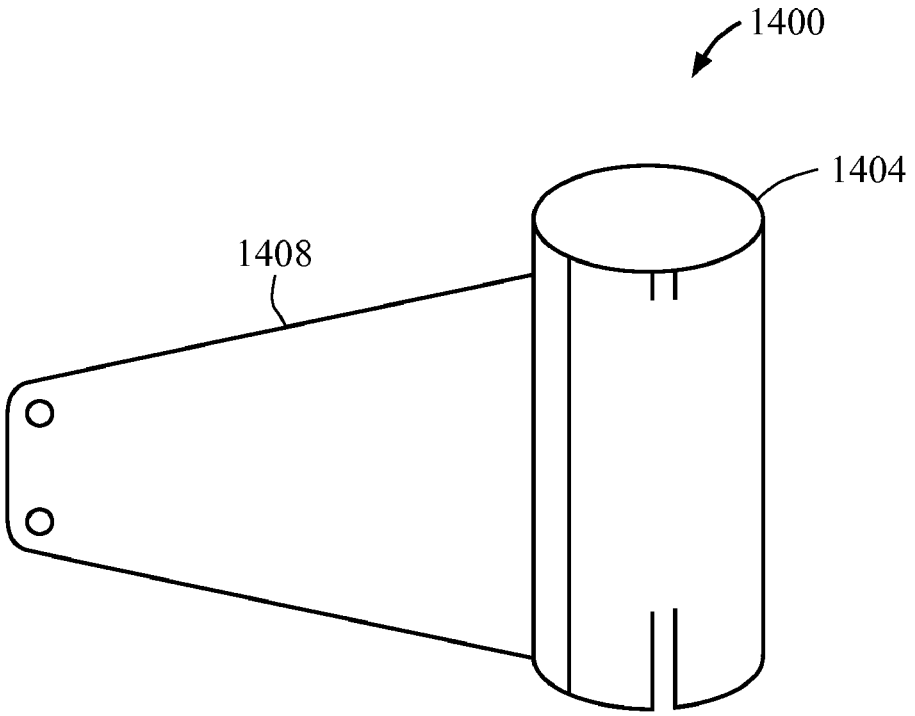
FIG. 14 illustrates a winged hinge lock according to one embodiment of the invention.

FIG. 14 illustrates a winged hinge lock according to one embodiment of the invention. The winged hinge lock 1400 includes a hinge body 1404 and a hinge wing 1408 coupled to the hinge body 1404. The hinge body 1404 is sized and shaped to fit around the door hinge. The hinge wing 1408 is positioned so that the hinge wing 1408 prevents movement of the door.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

What is claimed is:

1. A hinge lock comprising:

a lock body configured to be positioned around at least a portion of a pivot pin of a hinge in a locked position and to be positioned above the pivot pin in an unlocked position; and a spring-loaded shaft in the lock body and engageable with the pivot pin of the hinge, the spring-load shaft comprising a compressible spring;

wherein the lock body is in the locked position when the spring in the spring-loaded shaft is compressed, and wherein the lock body is in an unlocked position when the spring in the spring-loaded shaft is decompressed, and wherein the lock body is configured to selectively engage with hinge wings of the hinge in said locked position to restrain relative movement of the hinge wings and disengage from said hinge wings of the hinge in said unlocked position to allow relative movement of the hinge wings.

2. The hinge lock of claim 1, wherein the lock body comprises a hood, and wherein the hood restrains relative movement of the hinge wings.

* * * * *